US005690235A

United States Patent [19]

Matzen

[11] Patent Number: 5,690,235

[45] Date of Patent: Nov. 25, 1997

[54] BAT SUSPENSION DEVICE

[76] Inventor: Larry H. Matzen, 24689 N. Scott Park Rd., Eldridge, Iowa 52748

[21] Appl. No.: 679,602

[22] Filed: Jul. 10, 1996

[51] Int. Cl.[6] ..... A47F 7/00

[52] U.S. Cl. ..... 211/60.1; 211/13; 211/14; 211/87; D6/552

[58] Field of Search ..... 211/60.1, 87, 88, 211/13, 14; D6/552

[56] References Cited

U.S. PATENT DOCUMENTS

| | | | |
|---|---|---|---|
| D. 346,520 | 5/1994 | Barfield | D6/552 |
| D. 353,067 | 12/1994 | Asmar . | |
| D. 356,002 | 3/1995 | Morgan . | |
| D. 363,184 | 10/1995 | Elhage | D6/552 |
| D. 373,498 | 9/1996 | Young | D6/552 |
| 3,491,893 | 1/1970 | Morris . | |
| 3,698,563 | 10/1972 | Gordon et al. | 211/13 |
| 3,871,526 | 3/1975 | Marsack . | |
| 4,049,126 | 9/1977 | Halverson | 211/104 |
| 4,583,647 | 4/1986 | Schinzing | 211/60.1 |
| 4,807,763 | 2/1989 | Jankovsky . | |
| 4,936,467 | 6/1990 | Bobeczko . | |
| 5,054,625 | 10/1991 | Foley . | |
| 5,085,327 | 2/1992 | Mercer et al. | 211/14 X |
| 5,224,602 | 7/1993 | Bettles et al. | 206/579 |
| 5,294,005 | 3/1994 | Hedges | 211/13 |

*Primary Examiner*—Robert W. Gibson, Jr.
*Attorney, Agent, or Firm*—Henderson & Sturm

[57] ABSTRACT

A bat suspension device (10) for suspending a plurality of bats (50) and/or balls (60) from a chain link fence (100); wherein, the device (10) comprises an elongated hollow body member (20) provided with a plurality of contoured apertures (30) each dimensioned to receive selected portions of a bat (50), and wherein the body member (20) is provided with fastening means (40) for releasably securing the device (10) to a chain link fence (100).

10 Claims, 1 Drawing Sheet

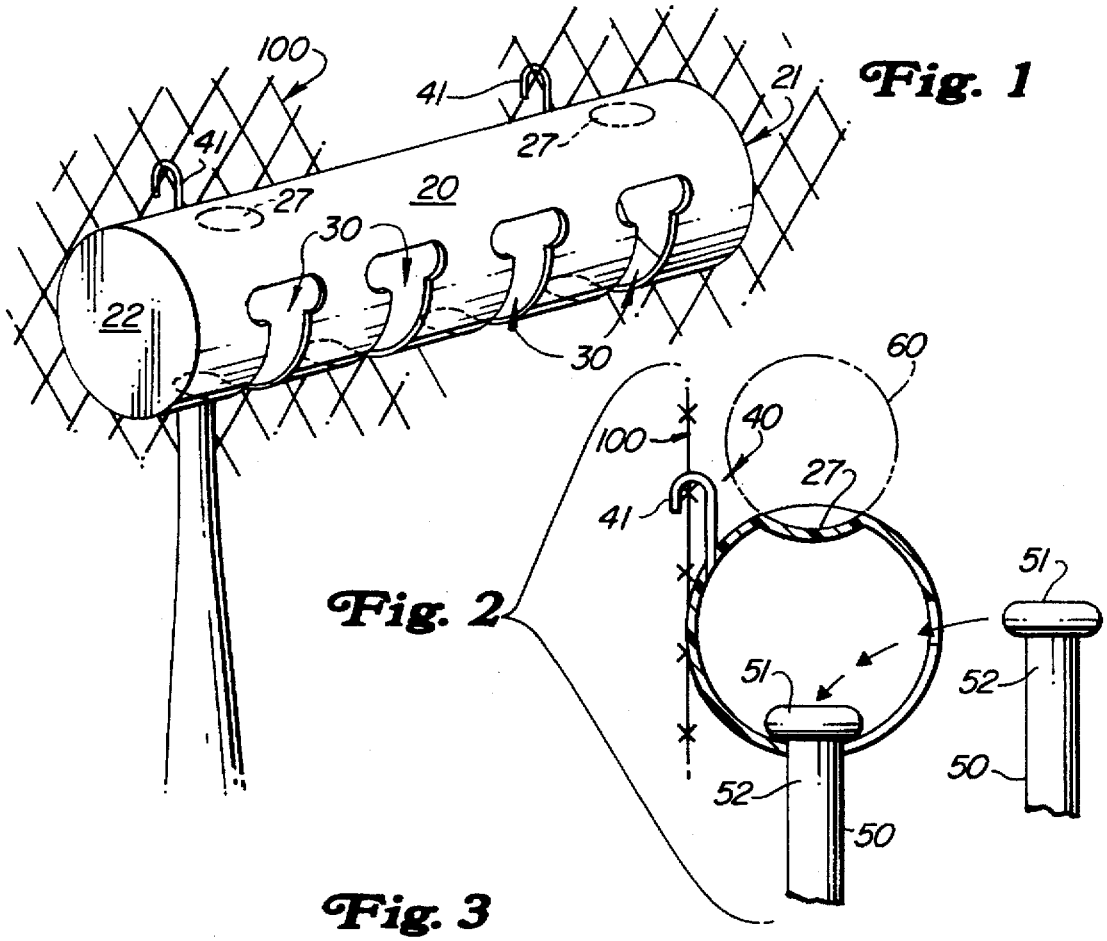
Fig. 1
Fig. 2
Fig. 3
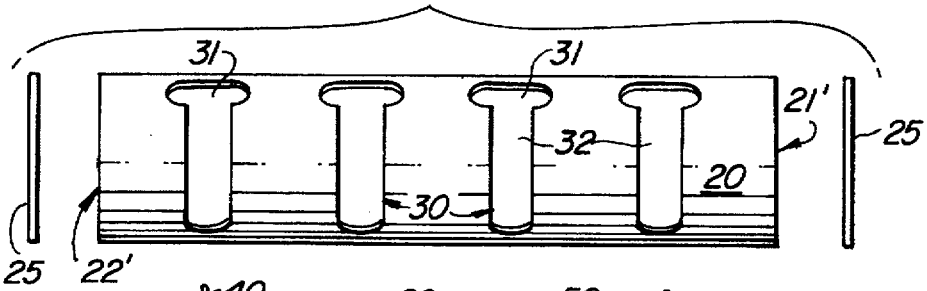
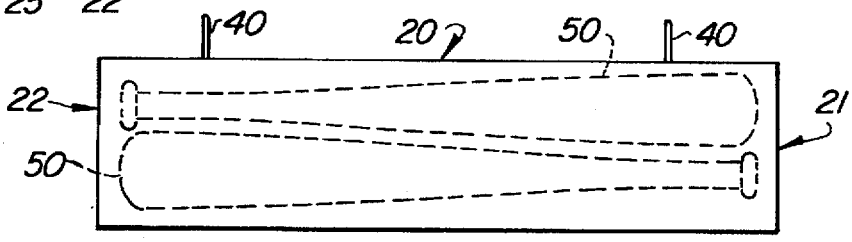
Fig. 4
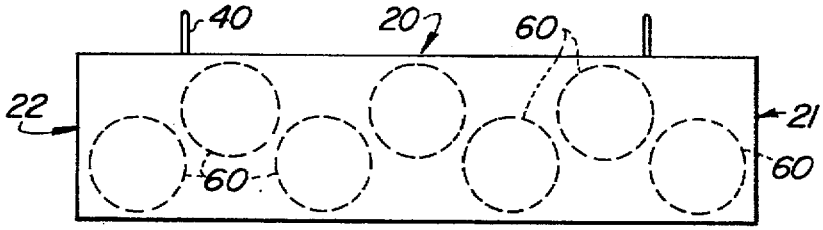
Fig. 5

BAT SUSPENSION DEVICE

TECHNICAL FIELD

The present invention relates to the field of athletic equipment in general; and, in particular to a device that can suspend a plurality of bats from a section of chained link fencing.

BACKGROUND ART

As can be seen by reference to the following U.S. Pat. Nos. 4,049,126; 3,491,893; 4,583,647; and 5,224,602 the prior art is replete with myriad and diverse bat storage and/or suspension devices.

While all of the aforementioned prior art constructions are more than adequate for the basic purpose and function for which they have been specifically designed, and at least some of these prior art constructions are specifically designed to be employed in conjunction with a chain link fence, none of these patented devices contemplates the wide range of useful functions that can be provided by the subject matter of the present invention.

In fact virtually all of the prior art is solely concerned with suspending or in the alternative storing bats in a convenient location, and they do not even remotely suggest combining both the storage and suspension capabilities into a single structure.

Furthermore, none of the prior art constructions make any provision for the storage, transport, or ready access to extra balls which may be required during practice, warm-ups or during a game.

As a consequence of the foregoing situation, there has existed a longstanding need for a bat suspension device that also provides a storage capability for both bats and for balls when not in use or while being transported to and from the point of use and the provision of such a construction is a stated objective of the present invention.

DISCLOSURE OF THE INVENTION

Briefly stated, the bat suspension device that forms the basis of the present invention comprises a generally elongated hollow cylindrical body member provided with a plurality of contoured apertures which are dimensioned to releasably receive the knobbed end of the bat handle.

As will be explained in greater detail further on in the specification, the cylindrical body member is also provided with securing means for releasably attaching the cylindrical body member to a section of chain link fencing, so that the bats may be suspended therefrom.

In addition, the interior of the hollow body member is further dimensioned to accommodate one or more bats and/or balls as the device is being transported to and from its place of use; and, may optionally be provided with means for converting the device into a transport and storage receptacle for bats and/or balls.

BRIEF DESCRIPTION OF THE INVENTION

These and other attributes of the invention will become more clear upon a thorough study of the following description of the best mode for carrying out the invention, particularly when reviewed in conjunction with the drawings, wherein:

FIG. 1 is a perspective view of the bat suspension device that forms the basis of the present invention installed on a chain link fence;

FIG. 2 is a side view of FIG. 1;

FIG. 3 is a detail view showing the configuration of the contoured apertures in the side and bottom portions of the device;

FIG. 4 is a top plan view of the device used to store a plurality of bats; and, FIG. 5 is a bottom plan view of the device used to store a plurality of balls.

BEST MODE FOR CARRYING OUT THE INVENTION

As can be seen by reference to the drawings, and in particular to FIG. 1, the bat suspension device that forms the basis of the present invention is designated generally be the reference numeral (10).

The device (10) comprises in general an elongated hollow body member (20) provided with a plurality of contoured apertures (30) and having fastening means (40) for releasably securing the body member (20) to a section of conventional chain link fence designated generally as (100).

In the first version of the preferred embodiment illustrated in FIGS. 1, 4, and 5 the elongated hollow body member (20) has a generally cylindrical configuration; wherein, one end (21) of the cylindrical body member (20) is open, and the other end (22) of the body member is closed; and, is dimensioned such that the body member (20) forms a storage receptacle for a plurality of bats (50) and/or balls (60) as the device (10) is transported to and from its place of use. However, in the second version of the preferred embodiment depicted in FIGS. 2 and 3 the body member is hollow throughout such that both ends ($21^1$) and ($22^1$) are open; yet, may optionally be provided with removable end caps (25) to form a closed receptacle.

As can best be appreciated by reference to FIGS. 1 through 3, each one of the plurality of contoured apertures (30) has an enlarged head portion (31) dimensioned to receive the knobbed end (51) of a bat (50) and an elongated narrow stem portion (32) which is dimensioned to only receive the narrow handle portion (52) of the bat (50).

As shown in FIG. 2, the knobbed end (51) of the bat (50) is inserted through the enlarged head portion (31) of one of the contoured apertures (30), so that the narrow handle portion (52) of the bat (50) can slide into the narrow stem portion (32) of the aperture (30) to suspend the bat (50) from within the device (10) in a well recognized fashion.

As can best be seen by reference to FIGS. 1 and 2 the fastening means (40) of the preferred embodiment comprise a pair of hook elements (41) which project upwardly and outwardly from the rear surface of the hollow body member (20); wherein, the hook elements (41) engage spaced portions on a chain link fence (100) to suspend the device (10) at a desired height above the ground so that the bats may be stored in a suspended manner at a convenient location.

Still referring to FIGS. 1 and 2 it should be appreciated that when the bats (50) are suspended within the device (10) the handle portions (52) of the bats (50) are kept dry during inclement weather that may or may not warrant a rain delay.

In addition, this invention further contemplates the provision of one or more shallow recesses (27) formed in the upper surface of the hollow body member (20); wherein, the recesses (27) are dimensioned to receive a portion of one of the balls (60).

It should also be noted at this juncture that while a pair of hook elements (41) has been mentioned as the preferred fastening means (40) for the device (10) any other suitable fastening means (40) such as straps, clips, etc. could be substituted therefor in keeping with the teachings of this invention.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A bat suspension device for suspending a plurality of bats and/or balls from a section of chain link fence wherein the device comprises:

an elongated hollow body member provided with a plurality of contoured apertures wherein each aperture is dimensioned to receive selected portions of a bat; and, fastening means for releasably securing the hollow body member to spaced locations on the chain link fence.

2. The device as in claim 1; wherein, the elongated hollow body member has a generally cylindrical configuration.

3. The device as in claim 2; wherein, both ends of the hollow body member are open.

4. The device as in claim 3; wherein, at least one of the ends of the hollow body member is provided with a removable end cap.

5. The device as in claim 2; wherein, one of the ends of the hollow body member is closed.

6. The device as in claim 1; wherein, the interior of the hollow body member is dimensioned to receive a plurality of balls.

7. The device as in claim 1; wherein, the interior of the hollow body member is dimensioned to receive at least one bat.

8. The device as in claim 1; wherein, the exterior of the hollow body member is provided with at least one recess that is dimensioned to receive a portion of a ball.

9. The device as in claim 1; wherein, each bat has a knobbed end and a narrow handle portion and each of the plurality of contoured apertures is provided with: a narrow stem portion which is dimensioned to only accept the narrow handle portion of the bat; and, an enlarged head portion which is dimensioned to receive both the narrow handle portion and the knobbed end of the bat.

10. The device as in claim 9; wherein, the hollow body member forms a cover for the knobbed end of the bat.

* * * * *